US011230842B1

(12) United States Patent
Thiebaud et al.

(10) Patent No.: US 11,230,842 B1
(45) Date of Patent: Jan. 25, 2022

(54) ROOFING SYSTEM AND METHOD OF USE

(71) Applicants: Austin Thiebaud, Burleson, TX (US); Chelsey Thiebaud, Burleson, TX (US)

(72) Inventors: Austin Thiebaud, Burleson, TX (US); Chelsey Thiebaud, Burleson, TX (US)

( * ) Notice: Subject to any disclaimer, the term of this patent is extended or adjusted under 35 U.S.C. 154(b) by 0 days.

(21) Appl. No.: 16/598,620

(22) Filed: Oct. 10, 2019

(51) Int. Cl.
*E04D 1/18* (2006.01)
*E04D 12/00* (2006.01)

(52) U.S. Cl.
CPC ..... *E04D 1/18* (2013.01); *E04D 12/004* (2013.01)

(58) Field of Classification Search
CPC ..... E04D 1/18; E04D 12/004
See application file for complete search history.

(56) References Cited

U.S. PATENT DOCUMENTS 3,373,534 A * 3/1968 Berridge ..... E04D 12/006 52/478
4,120,132 A * 10/1978 Kendrick ..... E04B 7/205 52/478
5,056,288 A * 10/1991 Funaki ..... E04D 3/362 52/545
5,737,881 A * 4/1998 Stocksieker ..... E04D 1/18 52/460
6,907,701 B2 * 6/2005 Smith ..... E04D 3/30 52/309.8
6,948,288 B1 * 9/2005 Smith ..... E04D 12/00 52/309.8
10,171,025 B2 * 1/2019 Flaherty ..... H02S 20/23
2011/0314758 A1 * 12/2011 Mora ..... E04D 1/34 52/302.1

* cited by examiner

*Primary Examiner* — Beth A Stephan
(74) *Attorney, Agent, or Firm* — Leavitt Eldredge Law Firm

(57) ABSTRACT

A roofing system includes a roofing panel, the roofing panel having a main body extending from a first side to a second side and from a top end to a bottom end, the roofing panel further having a first lip extending upward and away from the top end; and a second lip extending downward from the bottom end; a support having a body in the shape of a wedge, the body extending from a bottom to a top, the bottom has a thickness greater than the top; a roof structure; the support is positioned between the roof structure and the roofing panel; the bottom of the support aligns with the second lip of the roofing panel; and the support extends partially along a width of the roofing panel.

5 Claims, 5 Drawing Sheets

ROOFING SYSTEM AND METHOD OF USE

BACKGROUND

1. Field of the Invention

The present invention relates generally to roofing systems and methods of building the same, and more specifically, to a roofing system that utilizes wedge-shaped supports to prevent damage to roofing panels and further provides for insulation.

2. Description of Related Art

Roofing systems are well known in the art and are effective means to build a roof or modify a roof of an existing building. For example, FIG. 1 depicts a flowchart 101 of a conventional method, wherein a plurality of roofing panels is purchased, as shown with box 103. The builder will then proceed to lay out a bottom layer, that may be composed of felt or similar material, as shown with box 105. Then the builder will lay out and secure the plurality of panels into a plurality of rows to build the roof, as shown with boxes 107, 109. It should be appreciated that there are many modifications of conventional systems, however, there is always room for improvement in materials, and design features, these improvements being directed to improving efficiency in the build, reducing cost, improving insulation, or further to improve durability.

Accordingly, it is an object of the present invention to provide a roofing system that utilizes durable roofing panels and provides for an addition of a support that helps ensure that the roofing panels are aesthetically protected and further provides for efficient insulation associated with the roof.

Accordingly, although great strides have been made in the area of roofing systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
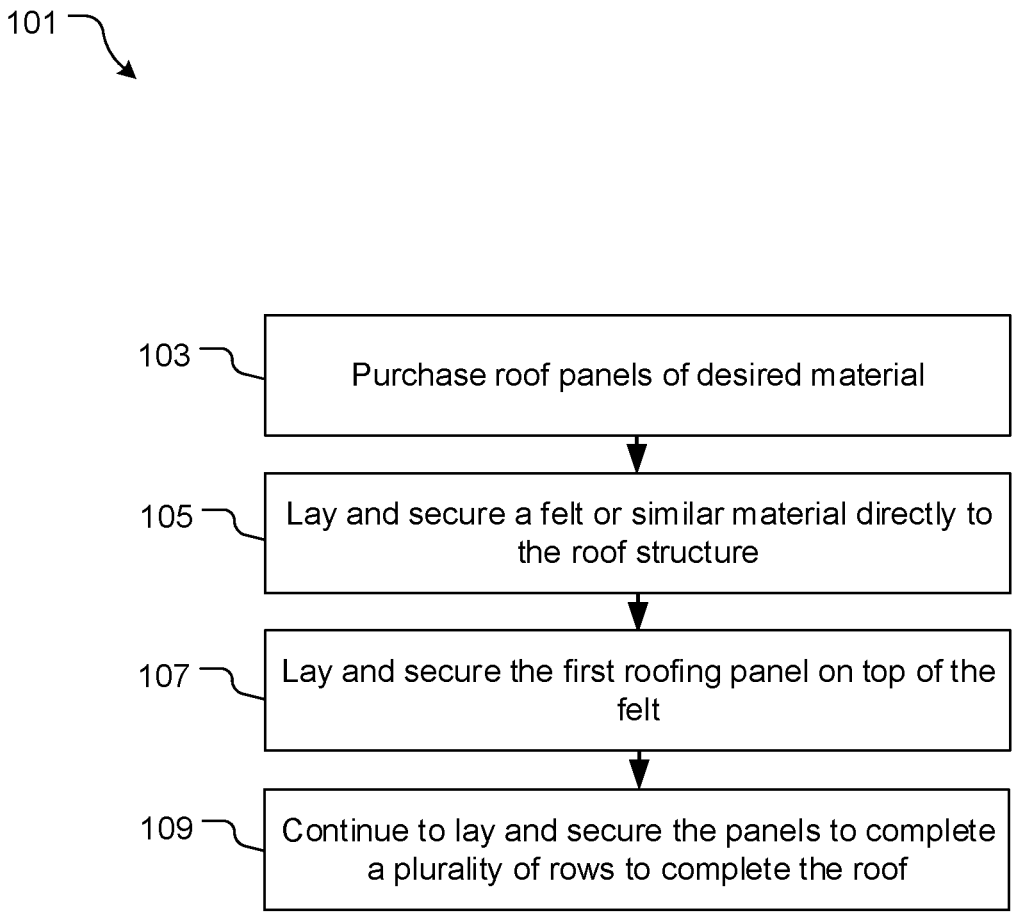
FIG. 1 (Prior Art)
FIG. 1 is a flowchart of a common roof installation method.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional roofing systems. Specifically, the present invention provides for a roofing system that utilizes a support that provides for improved insulation and installation of roofing panels. This and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
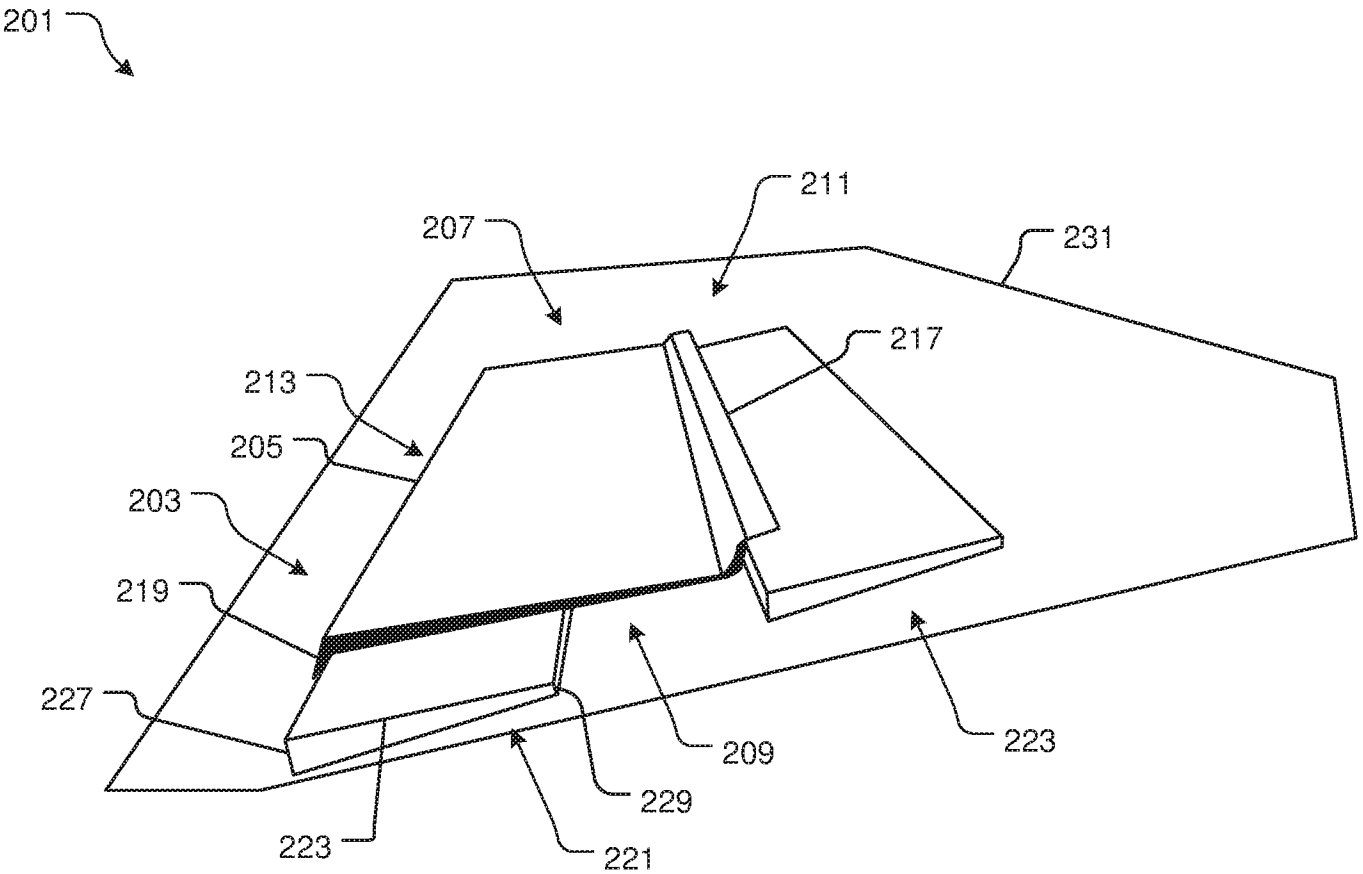
FIG. 2 is an isometric view of a roofing system in accordance with a preferred embodiment of the present application.

Referring now to the drawings wherein like reference characters identify corresponding or similar elements throughout the several views, FIG. 2 depicts an isometric view of a roofing system 201 in accordance with a preferred embodiment of the present application. It will be appreciated that system 201 overcomes one or more of the above-listed problems commonly associated with conventional roofing systems.

In the contemplated embodiment, system 201 includes one or more roofing panels 203, the roofing panel having a main body 205 extending from a first side 207 to a second side 209 and from a top end 211 to a bottom end 213. As shown, the roofing panel further includes a first lip 217 extending upward and away from the top end, and a second lip 219 extending downward from the bottom end.

System 201 further includes one or more supports 221, 223 having a body 225 in the shape of a wedge, the body extending from a bottom 227 to a top 229, wherein the bottom has a thickness greater than the top.

The supports 221, 223 are configured to be positioned on top of a roof structure 231, wherein the bottom of the support aligns with the second lip of the roofing panel, and wherein the support extends partially along a width of the roofing panel.

Figure 3:
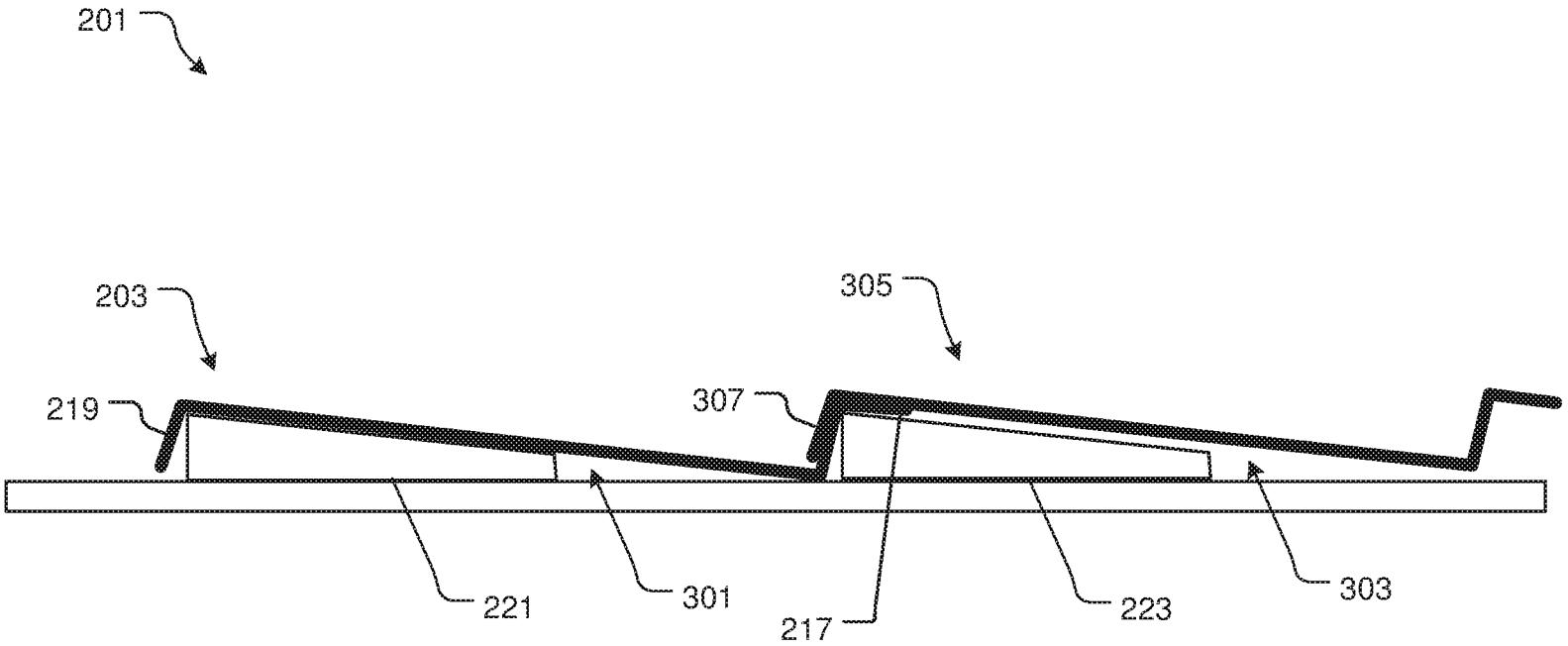
FIG. 3 is a side view of the roofing system of FIG. 2.

As best shown in FIG. 3, it should be appreciated that the extending of the support only partially the width of the panel can provide for benefits over the prior art, namely this allows for a gap 301, 303 to be created between the panels 203, 305 and the roof structure 231, wherein the gap helps the roofing system achieve an ambient temperature by creating a pocket where air enters on top of the foam but under the panel, thereby allowing for heated air to ventilate without penetrating into the attic/building.

The configuration of the supports 221, 223 under the panels 203, 305 is also best shown in FIG. 3, wherein the first panel 203 is secured such that second lip 219 secures over the bottom of the first support. The first lip 217 secured over the bottom of the second support 223, and the second lip 307 of the second panel 305 securing over the first lip of the first panel, thereby overlapping the panels. The user can secure the panels in place through any desirable means.

It should be appreciated that one of the unique features believed characteristic of the present application is the configuration of the supports and panels, wherein the supports fill in part of a gap created between the panels and the roof structure. This allows for workers to step on the panels without damaging the panels. Further, this provides for improve insulation through an economical design. It should be appreciated that the materials of the panels can vary, however, in the preferred embodiment the panels are primarily composed of one or more metals.

Figure 4:
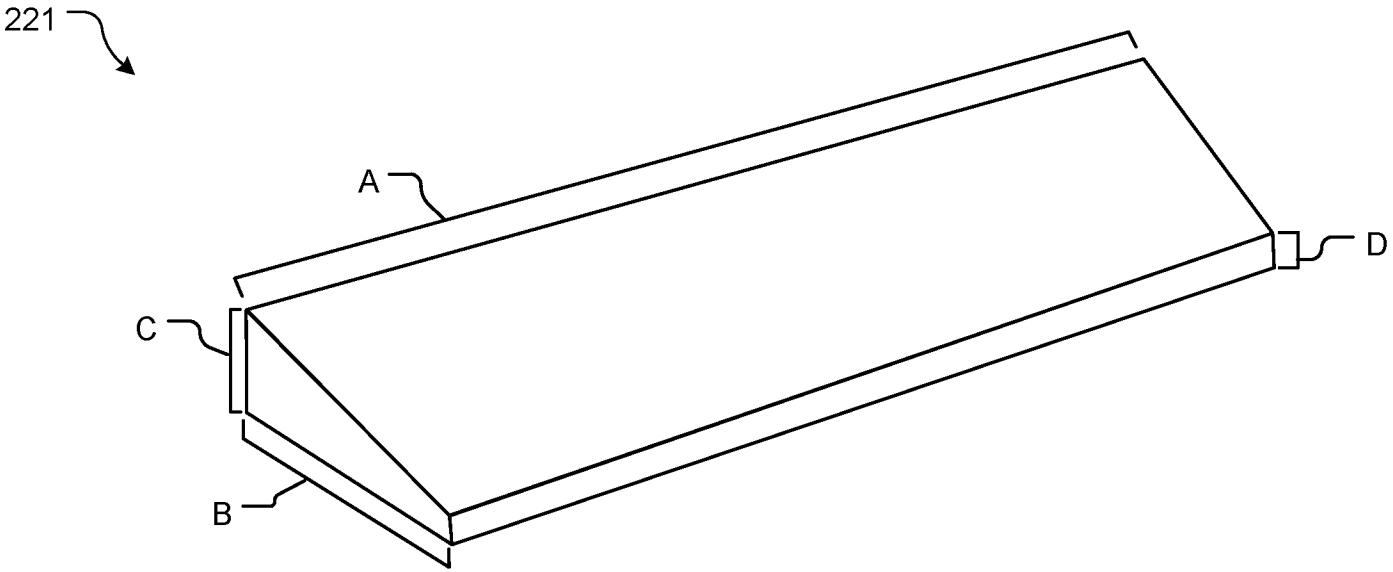
FIG. 4 is an isometric view of a preferred embodiment of a support of FIG. 2.

In FIG. 4, an isometric view of a support 221 is shown. It should be appreciated that the dimensions can vary, however in one embodiment the support 221 is approximately 49 inches long (A), 7½ inches wide (B), 1 inch deep at the bottom (C), and ¼ inch deep at the top (D). It should further be appreciated that the support 221 can vary in materials, however, in the preferred embodiment the support is composed of 1.5 lb density CNC hotwired polystyrene.

Figure 5:
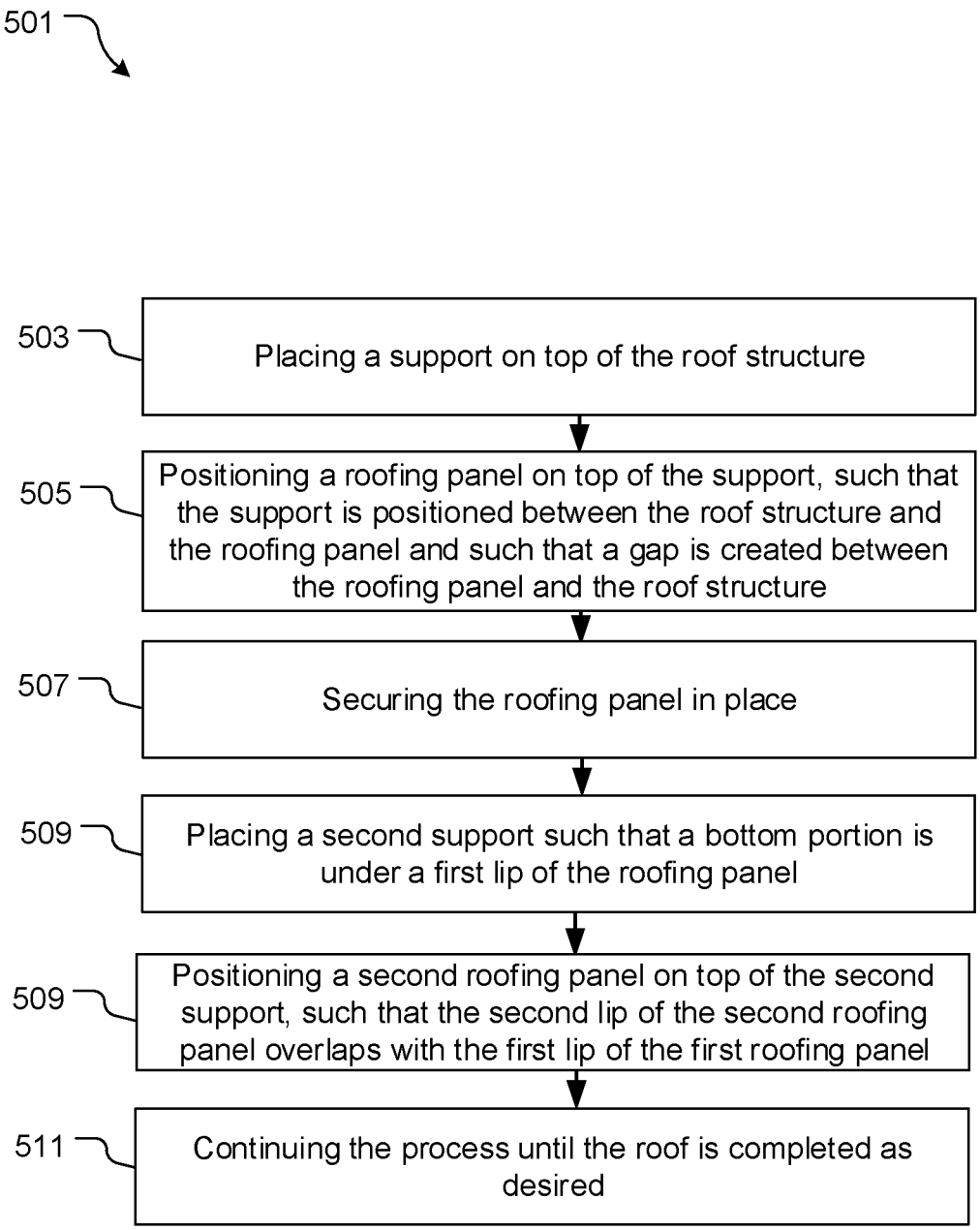
FIG. 5 is a flowchart of a method of use of the system of FIG. 2.

In FIG. 5, a flowchart 501 depicts a method of use of system 201. During use, the builder/worker will place a first support on top of a roof structure and underneath a first roofing panels, as shown with boxes 503, 505. In this configuration, there is a gap created between the panel and the roof structure, which allows for improve insulation and airflow. The builder/worker will then proceed to secure the roofing panel in place and moves on to the second support and panel, wherein the second support is positioned under a top portion of the first panel and under a bottom portion of the second panel, as shown with boxes 507, 509. The user can continue this process until the roof project is completed, as shown with box 511.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A roofing system, comprising:

a first and a second roofing panel, each of the roofing panels having:

a main body extending from a first side to a second side and from a top end to a bottom end, the top end and the bottom end forming a body width therebetween, the roofing panel further having:

a bottom surface;

a first lip extending upward and away from the top end; and a second lip extending downward from the bottom end; and a support having a body in the shape of a wedge, the body extending from a bottom edge to a top edge, wherein the bottom edge has a thickness greater than a thickness of the top edge, the top edge and the bottom edge forming a support width therebetween, the body width is greater than the support width, the support is composed of 1.5 lb density hotwired polystyrene;

the system further comprising:

a roof structure having a surface; and a gap formed in the width direction between the bottom surface of the main body, the top end of the main body, the surface of the roof structure, and the top edge of the support;

wherein a portion of the first lip of the first panel rests on and is supported by the bottom edge and a top surface of the support of the second panel, wherein the bottom end of the main body of the second panel is supported on the portion of the first lip of the first panel, wherein the support is positioned between the roof structure and the roofing panel, the support rests on the surface of the roof structure; and wherein the support is approximately 49 inches long, 7½ inches wide, 1 inch deep at the bottom, and 4 inch deep at a top.

2. A method of installing a roof, the method comprising:

providing the system of claim 1;

placing the support on top of the roof structure, the support having a body in the shape of a wedge, the body extending from the bottom edge to the top edge, wherein the bottom edge has a thickness greater than the top edge;

positioning the roofing panel on top of the support, the roofing panel having the main body extending from the first side to the second side and from the top end to the bottom end, the roofing panel further having the first lip extending upward and away from the top end, and the second lip extending downward from the bottom end;

securing the roofing panel in place; and forming the gap by the bottom surface of the main body, the top edge of the support, and the surface of the roof structure wherein the bottom of the support aligns with the second lip of the roofing panel; and wherein the support extends partially along a width of the roofing panel.

3. The method of claim 2, further comprising:

placing a second support with a bottom portion under the first lip of the roofing panel;

wherein a body of the second support extends away from the roofing panel.

4. The method of claim 3, further comprising:

positioning a second roofing panel on top of the second support, such that a second lip of the second roofing panel is positioned over the first lip of the roofing panel.

5. The system of claim 1, wherein the roofing panel is composed of metal.

* * * * *